US005625701A

United States Patent [19]

Scanlan

[11] Patent Number: 5,625,701

[45] Date of Patent: Apr. 29, 1997

[54] LOUDSPEAKER DIAPHRAGM ATTACHING

[75] Inventor: James M. Scanlan, Marlborough, Mass.

[73] Assignee: Bose Corporation, Framingham, Mass.

[21] Appl. No.: 306,703

[22] Filed: Sep. 15, 1994

Related U.S. Application Data

[63] Continuation-in-part of Ser. No. 102,378, Aug. 5, 1993, abandoned.

[51] Int. Cl.[6] ..... H04R 25/00

[52] U.S. Cl. ..... 381/197; 381/204

[58] Field of Search ..... 381/199, 194, 381/193, 192, 197; 181/171, 172

[56] References Cited

U.S. PATENT DOCUMENTS

| | | | |
|---|---|---|---|
| 1,995,080 | 3/1935 | Shotwell | 381/194 |
| 2,231,479 | 2/1941 | Perry | 381/194 |
| 2,755,343 | 7/1956 | Levy | 381/193 |
| 3,240,882 | 3/1966 | Eichler | 381/194 |
| 4,118,605 | 10/1978 | Kobayashi | 179/115.5 |
| 4,737,992 | 4/1988 | Latham-Brown et al. | 381/194 |
| 5,008,945 | 4/1991 | Murayama et al. | 381/194 |

FOREIGN PATENT DOCUMENTS

| | | |
|---|---|---|
| 0030758 | 6/1981 | European Pat. Off. . |
| 2668018 | 4/1992 | France . |
| 0270981 | 6/1988 | Germany . |
| 4-111597 | 4/1992 | Japan . |

*Primary Examiner*—Sinh Tran
*Attorney, Agent, or Firm*—Fish & Richardson P.C.

[57] ABSTRACT

A loudspeaker includes a diaphragm having a neck with an annular edge, a voice-coil former having an annular edge and a spider. There is structure formed with an annular groove. The annular edge of the neck and the annular edge of the voice-coil former are connected together in the annular groove in fixed relationship to the spider.

12 Claims, 7 Drawing Sheets

LOUDSPEAKER DIAPHRAGM ATTACHING

This application is a continuation-in-part application of application Ser. No. 08/102,378 filed Aug. 5, 1993 now abandoned.

The invention relates in general to loudspeaker diaphragm attaching and more particularly to an improved joint among diaphragm neck, spider and voice-coil former.

According to the invention the annular edge of the diaphragm neck and annular edge of the voice-coil former are joined together to an annular region of the spider to form the neck joint.

According to a specific form of the invention, there is a loudspeaker driver basket having the motor structure located in front of the cone with the spider behind the motor structure resiliently supporting the rear edge of the coil former. The voice coil is located at the forward end of the coil former. The neck joint is in a groove in the spider.

The dual shear action of the neck joint in the novel cone/coil former/spider configuration increases the buckling load of the coil former. The spider groove provides a large bond area between the cone, former and spider, thus making a stronger neck joint. In addition, the groove aids in confining the bonding adhesive to a localized region which improves manufacturability by preventing the adhesive from flowing out of the desired joint. This invention also helps provide consistent acoustic properties of the manufactured loudspeaker drivers embodying the invention.

Generally, the adhesives used to couple the dustcap to conventional loudspeakers have variations in their stiffness, mass and damping characteristics. These variations are difficult to control and therefore result in variations in the frequency response of the loudspeakers. The novel cone/coil former/spider configuration eliminates the need for a dustcap and its associated adhesive joint, yet still prevents the ingress of dust into the motor structure and reduces variations in acoustic properties of manufactured drivers embodying the invention.

Numerous other features, objects and advantages of the invention will become apparent from the following specification when read in connection with the accompanying drawings in which.

Figure 1:
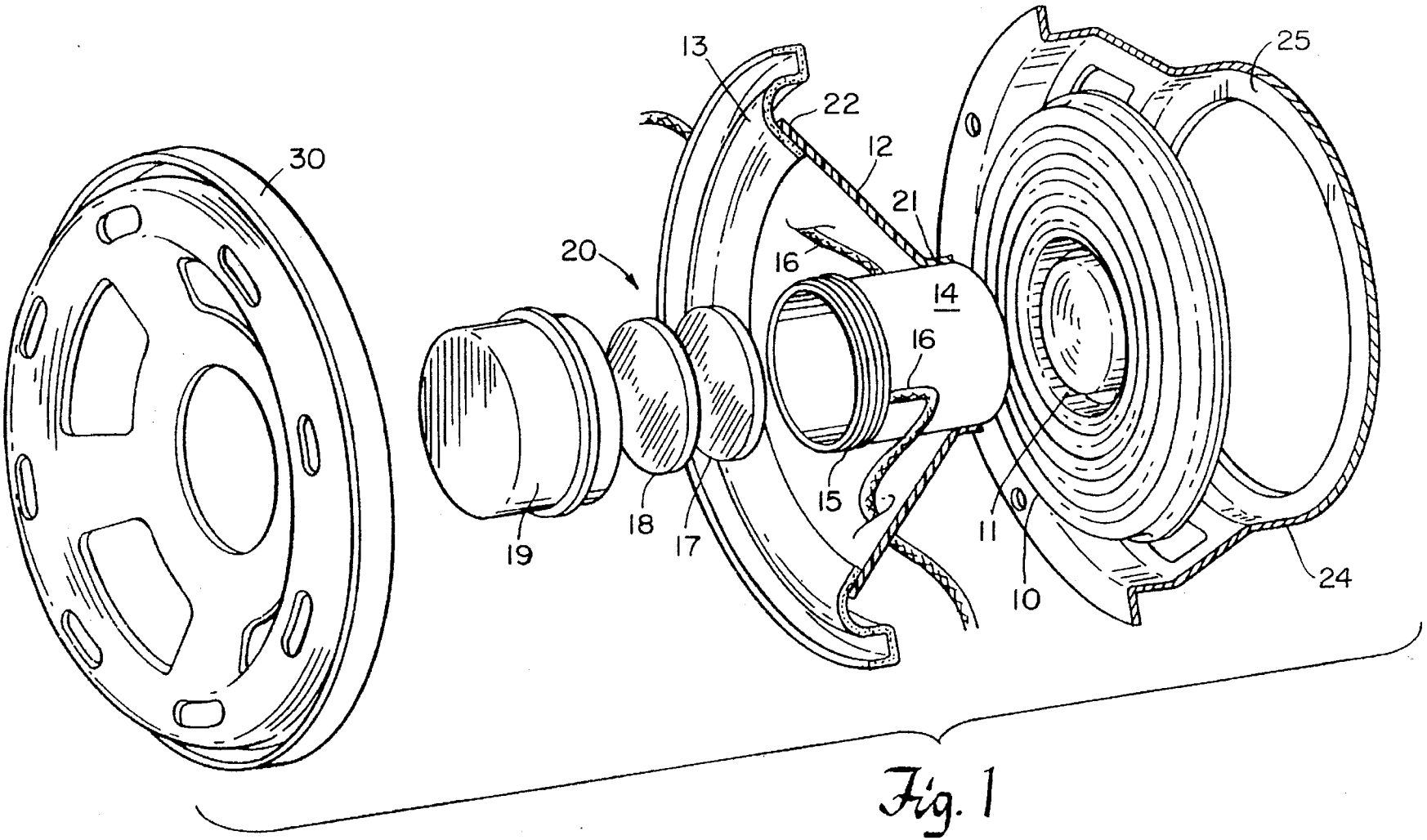
FIG. 1 is a mostly exploded view of a loudspeaker.

With reference now to the drawings and more particularly FIGS. 1–4 thereof, there is shown an exemplary embodiment of a loudspeaker according to the invention. Rear basket 24, preferably made from aluminum, has a bottom edge 25 coupled to the outer edge of spider 10. The spider is preferably made from a cotton-polyester blend and has a centrally disposed circular groove 11. Spider 10 extends completely over the opening in rear basket 24, thereby additionally functioning as a dust cap to help prevent debris from entering motor structure 20.

The central portion of spider 10, located inside groove 11, can be treated or impregnated with various stiffening agents well known in the art to achieve the traditional range of conventional dustcap properties. A light treatment will allow air to pass through spider 10 and over coil former 14, cooling voice coil 15 and motor structure 20. A stiffer treatment helps produce more acoustic energy at higher frequencies prevent buckling of the membrane at high pressure loads.

Paper or plastic cone 12 has annular foam surround 13 disposed around its outer edge 22. The inner annular edge 21 of the cone neck is bonded with the rear edge of coil former 14, preferably made from aluminum, inside groove 11 with a two-part epoxy adhesive, which is then cured at a high temperature.

Voice coil 15 is disposed at the forward edge of coil former 14 and is preferably made from copper clad aluminum wire. Tinsel leads 16 are coupled to voice coil 15 and are brought out through slits 40 in cone 12.

Motor structure 20 is supported on the inside of forward basket 30, which is preferably aluminum, and comprises a rearwardly opening cup-shaped yoke assembly formed with an annular recess 44 for accommodating voice coil 15. A neodymium-iron-boron circular disk magnet 18 is sandwiched between yoke 19 and coin 17 coacting with yoke 19 to define annular recess 44 and to provide a radial magnetic field between coin 17 and the cylindrical wall of yoke 19. Yoke 19 and coin 17 are preferably made from low-carbon steel.

In the final assembly, surround 13 is adhesively bonded between the rearward edge of the forward basket and the forward edge of the rear basket.

Figure 3:
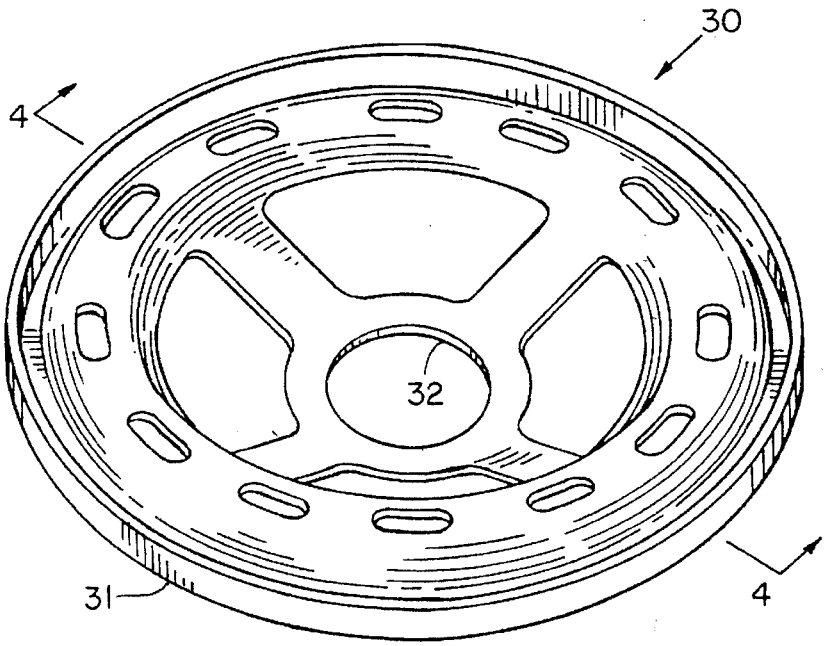
FIG. 3 is a top view of a loudspeaker.
Figure 4:
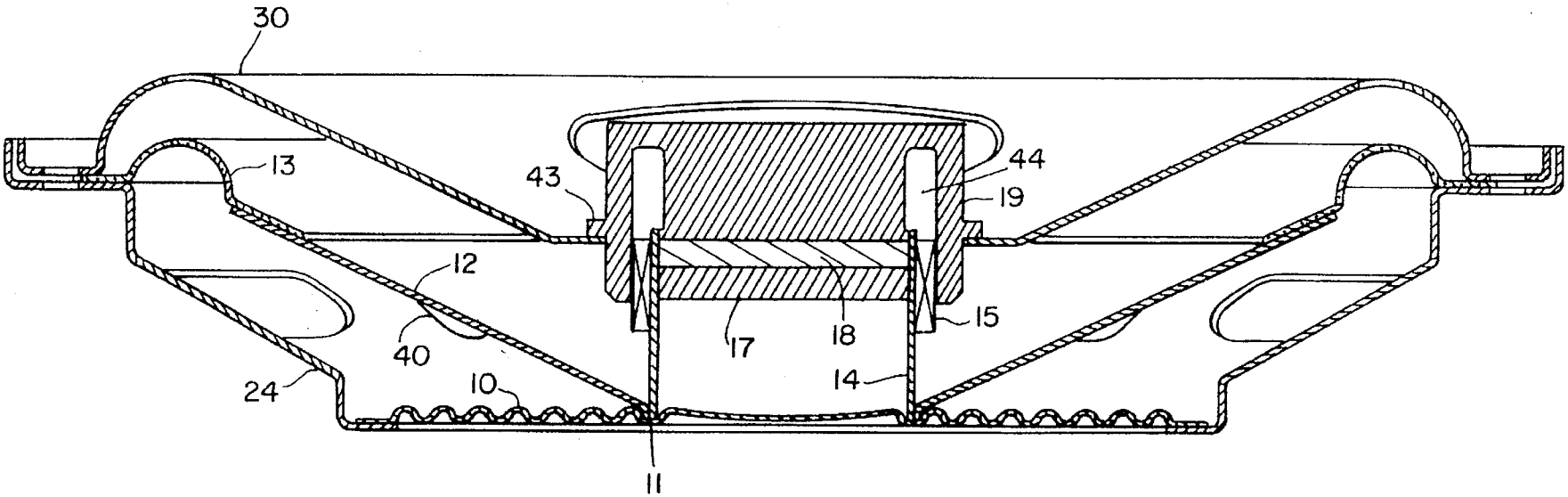
FIG. 4 is a sectional view through section 4—4 of FIG. 3.

As best seen in FIGS. 3 and 4, forward basket 30 has a circular opening 32 for accommodating yoke 19. Circular lip 43 of yoke 19 is bonded to the edge of circular opening 32.

Referring to FIG. 4, the distance between the top 30T of forward basket 30 and the bottom 24B of rear basket 24 is less than eight inches.

Figure 2:
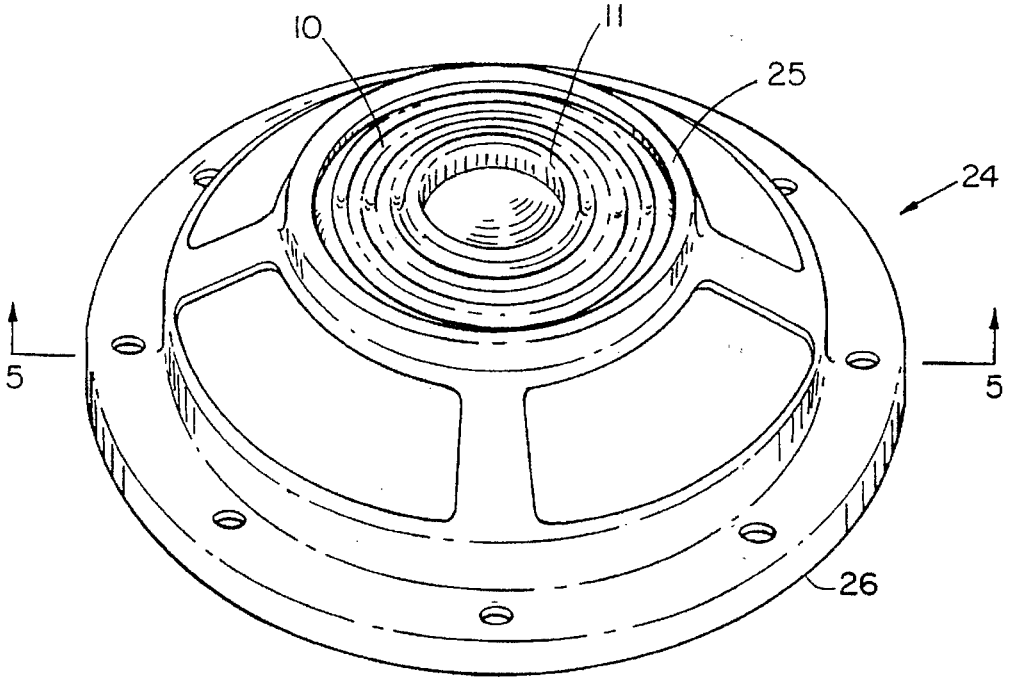
FIG. 2 is a bottom view of a loudspeaker.
Figure 5:
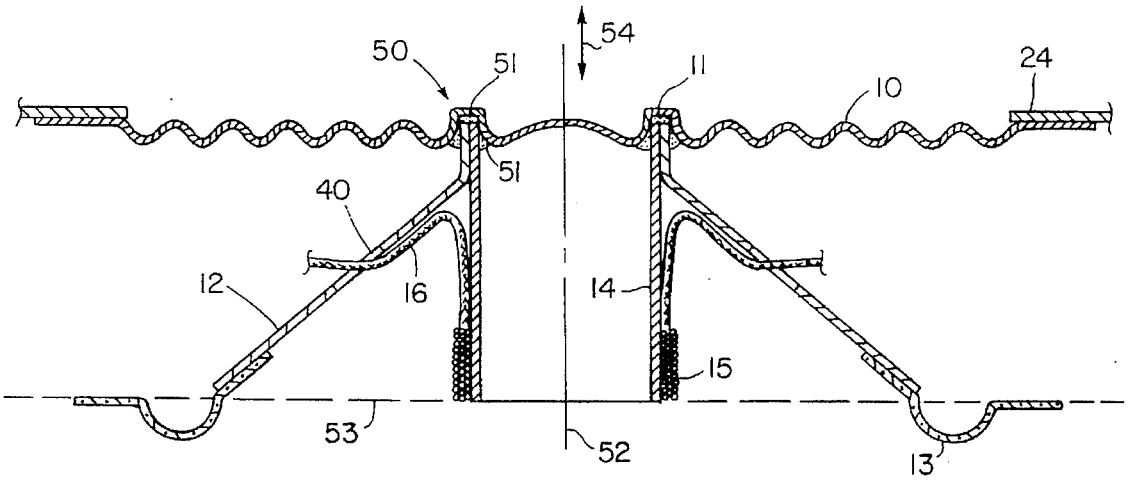
FIG. 5 is a sectional view through section 5—5 of FIG. 2.

Referring to FIG. 5, there is shown an enlarged sectional view of neck joint 50 along section 5—5 in FIG. 2. Generally, coil former 14 and cone 12 are pre-assembled with horizontal plane 53 of surround 13 perpendicular to axial plane 52 of former 14. Cone 12 and the rear edge of coil former 14 are then bonded to spider 10 in groove 11 with a high-temperature, two-part epoxy 51.

The groove 11 assists in centering and maintaining the perpendicularity of coil former 14 with respect to horizontal plane 53 of surround 13. In addition, groove 11 aids in confining bonding adhesive 51 to a localized region which improves manufacturability by preventing the adhesive from flowing out of the desired joint and into motor structure 20 or onto spider 10.

Figure 6:
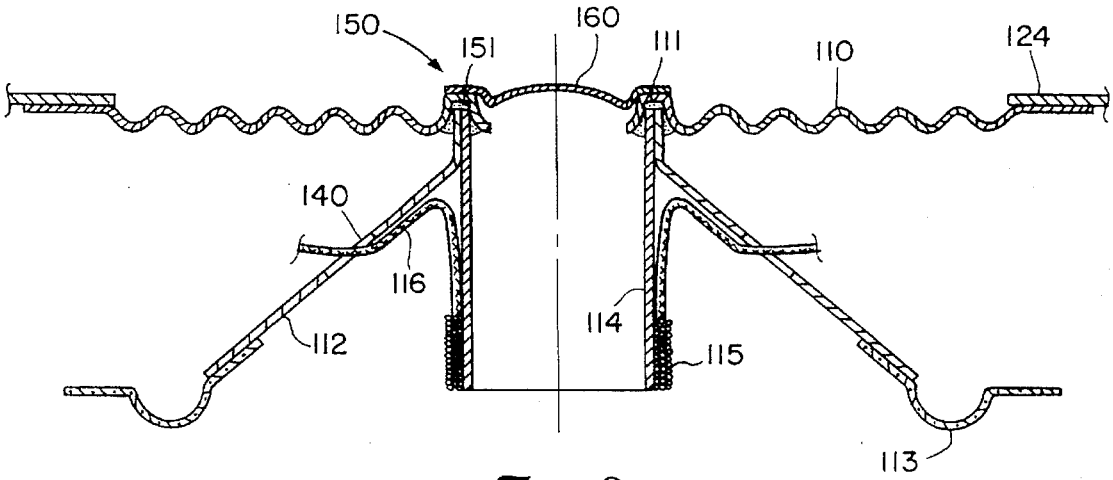
FIG. 6 is a sectional view of a loudspeaker neck joint according to an alternative mode of the invention.
Figure 7:
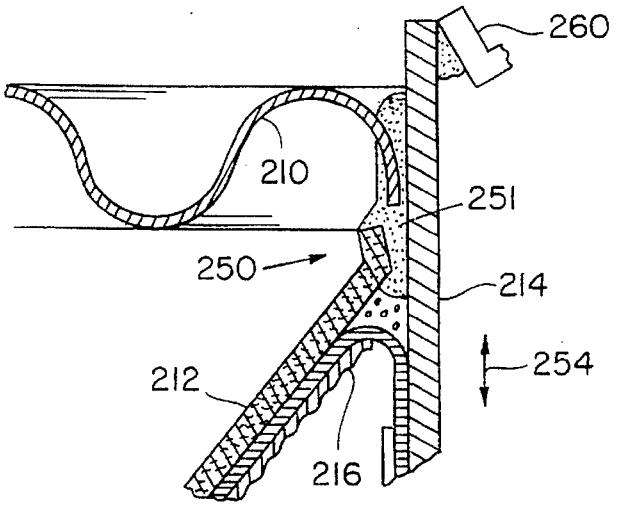
Fig. 7 PRIOR ART
FIG. 7 is a sectional view of a conventional loudspeaker neck joint.

A particularly important advantage of groove 11 can be seen by comparing neck joint 50 with a prior art neck joint 250, as shown in FIG. 7. In the prior art neck joint 250 only one surface of coil former 214 contacts one surface of spider 210 and cone 212. The neck joint according to the invention shown in FIGS. 5 and 6 has a significantly larger bond area to form a stronger joint.

Another advantage of the invention resides in the dual shear action of neck joint 50 increasing the buckling load of coil former 14. During operation of the loudspeaker, the coil former is displaced in the direction shown by arrow 54 in FIG. 5 and arrow 254 in FIG. 7. Prior art neck joint 250 creates a non-columnar, uneven pull on coil former 214. In contrast coil former 14 is always in either pure tension or pure compression, thereby extending the life of the neck joint. This feature is particularly important in woofers, where the coil former excursions are quite large and create large stresses at the neck joint.

FIG. 6 shows an alternative embodiment of the invention. Instead of the spider extending completely over the opening in the rear basket, spider 110, shown in FIG. 6, has a central circular opening concentric with groove 111, and having a smaller diameter than groove 111. Dustcap 160 covers the circular opening as shown to prevent dust from entering the magnetic gap and allowing the differential air pressure at the yoke to equalize the pressure in front of the cone.

Figure 8:
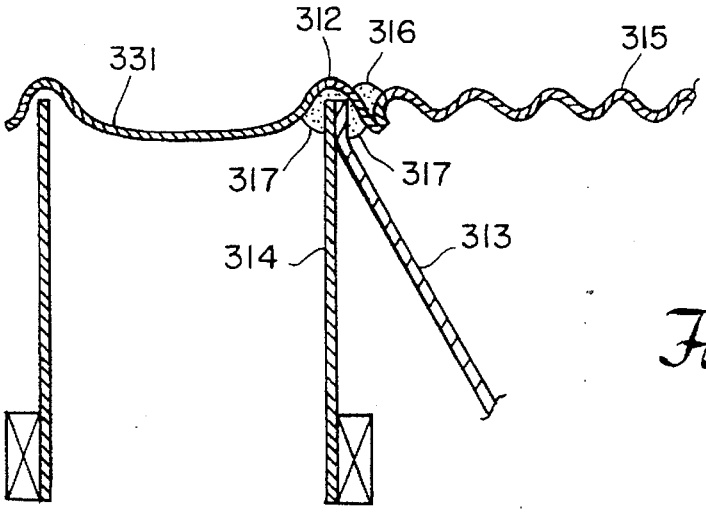
FIGS. 8 and 9 are partial axial sectional diagrammatic views of alternate embodiments of the invention with a groove in the dustcap.
Figure 9:
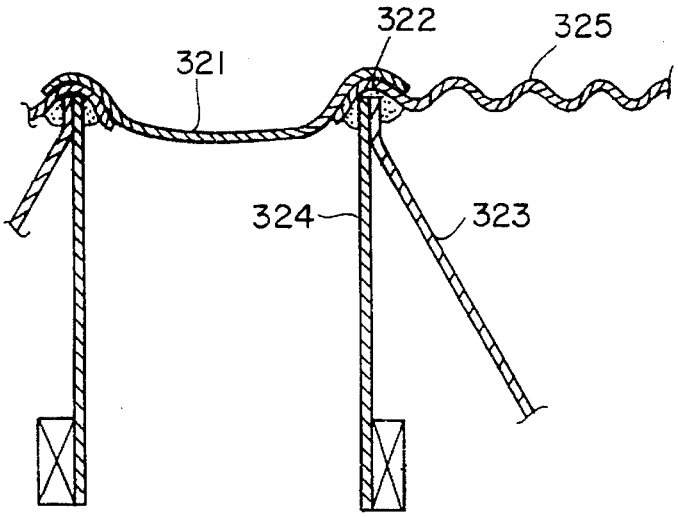

Referring to FIGS. 8 and 9 there are shown axial sectional diagrammatic views of alternative embodiments of the invention with the annular groove in the dustcap. In FIG. 8 dustcap 311 is formed with annular groove 312 accommodating the upper edges of cone 313 and former 314 secured therein with adhesive 317. Adhesive 316 secures the inside edge of spider 315 to dustcap 311. In FIG. 9 spider 325 is formed with annular groove 322 that accommodates the upper edges of cone 323 and former 324 with spider 325 secured to the outside edge of dustcap 321.

Figure 10:
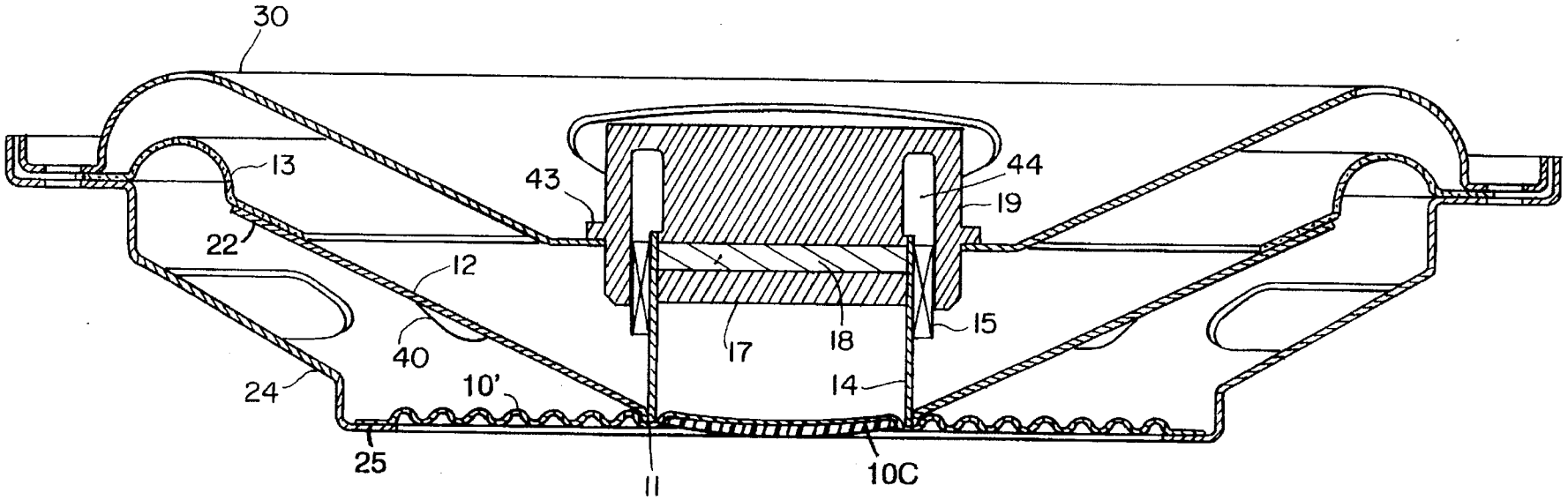
FIG. 10 is a modified sectional view through section 4—4 of FIG. 3 of an advantageous alternative water-resistant embodiment of the invention including laminated plastic over the center of the spider.

Referring to FIG. 10, there is shown a modified sectional view through section 4—4 of FIG. 3 of an alternative embodiment of the invention that is especially advantageous in exhibiting water-resistant properties. The same reference symbols identify corresponding elements throughout the drawings. In FIG. 10, spider 10' is a water-resistant blend of cotton and polyester. Another feature is the laminated plastic 10C over the center portion of spider 10'.

Figure 11:
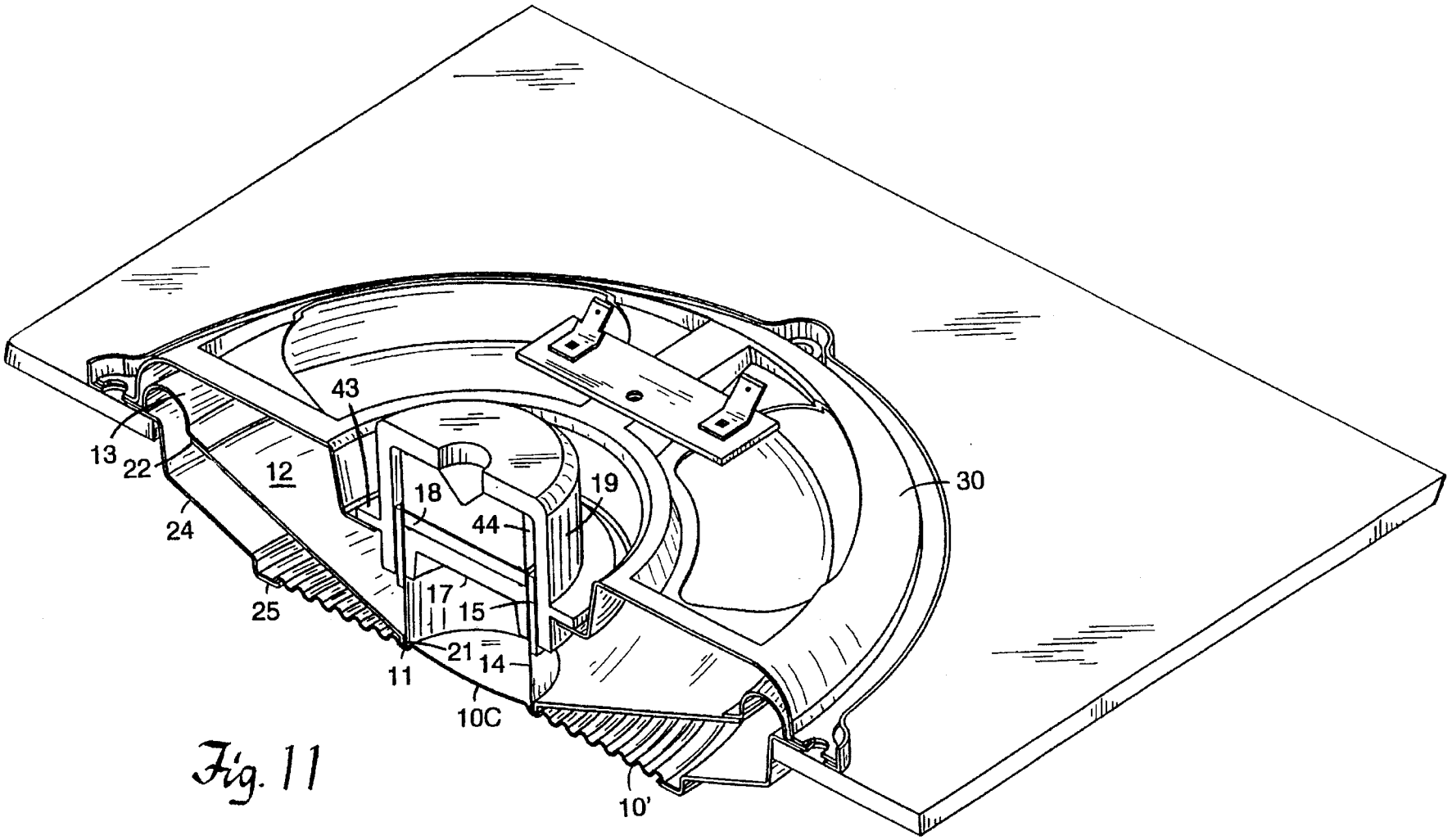
FIG. 11 is a fragmentary view of the embodiment of FIG. 10 seated in a vehicle door.

Referring to FIG. 11, there is shown a fragmentary view of the embodiment of FIG. 10 seated in a vehicle door. This combination is especially advantageous because rear basket 24 and spider 10' with the laminated plastic center 10C coact with gasket 401 to form a water-resistant assembly that keeps water from affecting the performance of the loudspeaker driver while reducing the cost and weight because the water-resistant compartment normally needed for a loudspeaker driver in a vehicle door is unnecessary with this embodiment of the invention. Yet, the invention provides high sound levels at bass frequencies without audible distortion.

Another advantage of the invention is that specific embodiments are thin enough to fit in the volume between 2×4 studs in buildings that typically have spacings of 14" between centers, thereby providing considerable bass from a speaker residing in the wall of a room.

Other embodiments are within the claims.

What is claimed is:

1. A loudspeaker having a central axis comprising, a diaphragm symmetrical about said central axis having neck with an annular edge parallel to said central axis, a voice-coil former surrounded by said diaphragm along significant portion of the length of said voice-coil former having an annular edge parallel to said central axis, structure formed with an annular groove, the annular edge of said neck and the annular edge of said voice-coil former connected together in said annular groove in fixed relationship to said structure and parallel to said central axis.

2. A loudspeaker having a central axis comprising, a diaphragm symmetrical about said central axis having a neck with an annular edge parallel to said central axis, a voice-coil former surrounded by said diaphragm along a significant portion of the length of said voice-coil former having an annular edge parallel to said central axis, structure formed with an annular groove, the annular edge of said neck and the annular edge of said voice-coil former connected together in said annular groove in fixed relationship to said structure and parallel to said central axis, wherein said structure comprises a spider.

3. A loudspeaker having a central axis comprising, a diaphragm symmetrical about said central axis having a neck with an annular edge parallel to said central axis, a voice-coil former surrounded by said diaphragm along a significant portion of the length of said voice-coil former having an annular edge parallel to said central axis, structure formed with an annular groove, the annular edge of said neck and the annular edge of said voice-coil former connected together in said annular groove in fixed relationship to said structure and parallel to said central axis, wherein said structure comprises a dustcap over said voice-coil former.

4. A loudspeaker comprising, a diaphragm having a neck with an annular edge, a voice-coil former having forward and rear annular edges, structure formed with an annular groove, the annular edge of said neck and the rear annular edge of said voice-coil former connected together in said annular groove in fixed relationship to said structure, a forward basket having a rearward edge surrounding an opening and having an inside region, a motor structure coupled centrally to the inside region of said forward basket having inner and outer walls and including a magnet for providing a magnetic field between said inner and outer walls, a rear basket having a bottom with a bottom edge surrounding a bottom opening and a forward edge surrounding an opening, said voice-coil former having a central lumen, said voice-coil former being constructed to pass between the inner and outer walls of said motor structure, a voice coil coupled around said forward annular edge of said voice-coil former, said diaphragm having an outer annular edge coupled between the rearward edge of said forward basket and the forward edge of said rear basket, said structure comprising a spider having an outer edge coupled to the bottom edge of said rear basket and having a front face coupled to the rear annular edge of said voice-coil former and said annular edge of said neck, said spider resiliently supporting the voice-coil former and the neck.

5. The loudspeaker of claim 4 wherein said spider extends over the entire expanse of the bottom opening of said rear basket.

6. The loudspeaker of claim 4 wherein, said rear edge of said voice-coil former and said annular edge of said neck are coupled to said spider at said annular groove disposed in the front face of said spider, said spider comprises a central opening concentric with said annular groove with a diameter smaller than a diameter of said annular groove, said loudspeaker further comprising a dustcap coupled to said spider and extending over the entire expanse of said central opening.

7. The loudspeaker of claim 4 wherein said loudspeaker is constructed with a distance of less than eight inches between the top of said forward basket and the bottom of said rear basket.

8. A loudspeaker comprising, a diaphragm symmetrical about said central axis having a neck with an annular edge parallel to said central axis, a voice-coil former surrounded by said diaphragm along a significant portion of the length of said voice-coil former having an annular edge parallel to said central axis, structure formed with an annular groove, the annular edge of said neck and the annular edge of said voice-coil former connected together in said annular groove in fixed relationship to said structure and parallel to said central axis, wherein said structure comprises a spider formed with said annular groove, and the annular edge of said voice-coil former and the annular edge of said neck are adhesively connected together to said annular groove.

9. A loudspeaker in accordance with claim 8 and further comprising, water-resistant plastic laminated to the center portion of said spider.

10. A loudspeaker in accordance with claim 8 wherein said water-resistant material is a mixture of cotton and polymer.

11. A loudspeaker in accordance with claim 10 and further comprising, water-resistant plastic laminated to a center portion of said spider.

12. A loudspeaker in accordance with claim 8 and further comprising, a vehicle door embracing said loudspeaker.

* * * * *